United States Patent [19]

Tsuzurahara

[11] 4,426,601

[45] Jan. 17, 1984

[54] MAGNETRON

[75] Inventor: Mamoru Tsuzurahara, Mobara, Japan

[73] Assignee: Hitachi, Ltd., Tokyo, Japan

[21] Appl. No.: 283,154

[22] Filed: Jul. 14, 1981

[30] Foreign Application Priority Data

Jul. 14, 1980 [JP] Japan ..... 55-95095

[51] Int. Cl.[3] ..... H01J 25/50

[52] U.S. Cl. ..... 315/39.51; 315/39.53; 315/39.71

[58] Field of Search ..... 315/39.71, 39.75, 39.51, 315/39.53

[56] References Cited

U.S. PATENT DOCUMENTS 3,809,950 5/1974 Koinuma et al. ..... 315/39.71
3,916,247 10/1975 Koinuma et al. ..... 315/39.71
4,075,534 2/1978 Saito ..... 315/39.71
4,163,175 7/1979 Tashiro ..... 315/39.71
4,282,463 8/1981 Nakai ..... 315/39.71
4,338,545 7/1982 Koinuma et al. ..... 315/39.71

*Primary Examiner*—Saxfield Chatmon, Jr.
*Attorney, Agent, or Firm*—Antonelli, Terry & Wands

[57] ABSTRACT

A magnetron having a pair of pole pieces arranged at both ends of a cylindrical anode, a pair of permanent magnets corresponding respectively to the pole pieces, and a pair of intermediate rings each disposed between the pole piece and the permanent magnet is disclosed, in which each of the intermediate rings includes a disc portion, a plurality of projections formed on one of the surfaces of the disc portion and abutting on the pole piece and a plurality of projections formed on the other surface of the disc portion and abutting on the permanent magnet.

3 Claims, 5 Drawing Figures

MAGNETRON

The present invention relates to a magnetron, and, more particularly, to an intermediate ring interposed between a permanent magnet and a pole piece which form a part of a magnetic circuit of the magnetron.

An object of the present invention is to provide a magnetron which can eliminate drawbacks encountered in the prior art in employing an expensive cooling system and which does not require high dimensional accuracy manufacturing thereof.

Another object of the present invention resides in providing a magnetron which readily absorbs mechanical shocks applied to the magnetron.

The prior art and the present invention and advantages of the latter will be described with reference to the accompanying drawings, in which.

Figure 1:
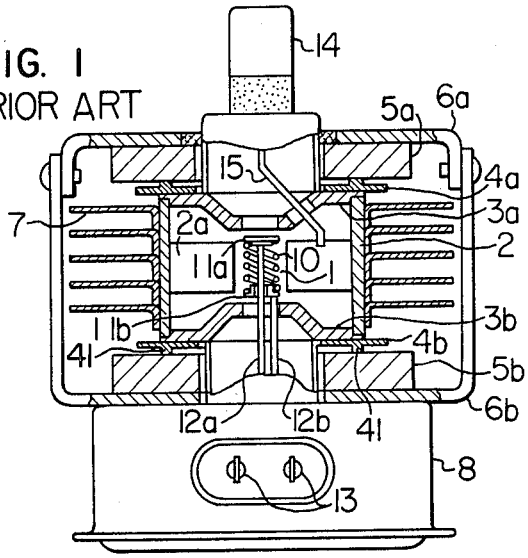
FIG. 1 PRIOR ART
FIG. 1 is an elevational view partially in cross-section showing a conventional magnetron.

Referring now to the drawings wherein like reference numerals are used throughout the various views to designate like parts and, more particularly, to FIG. 1, according to this figure a magnetron when a ferrite magnet is used, generally includes a cylindrical anode 2, having a plurality of vanes 2*a* to form a plurality of resonant cavities, disposed around a thermionic cathode 1, i.e., a hot cathode, with pole pieces 3*a* and 3*b* being provided at both ends of the cylindrical anode 2 to concentrate magnetic flux into an interaction space formed between the cathode 1 and anode 2. Thus, the cathode 1, anode 2 and pole pieces 3*a* and 3*b* make up the oscillating part of the magnetron. Further, doughnut shaped permanent magnets 5*a* and 5*b* are arranged with an intermediate ring 4*a* interposed between the pole piece 3*a* and the permanent magnet 5*a*, and with the intermediate ring 4*b* interposed between the pole piece 3*b* and permanent magnet 5*b*. A pair of yokes 6*a* and 6*b* are brought into contact with the permanent magnets 5*a* and 5*b*, respectively, and then mechanically combined by, for example, screw bolts. The permanent magnets 5*a* and 5*b*, intermediate rings 4*a* and 4*b*, pole pieces 3*a* and 3*b*, interaction space, and yokes 6*a* and 6*b* form the magnetic circuit of the magnetron. The yokes 6*a* and 6*b*, fashioned as channel members, form a closed channel when assembled as described above, with oscillating part, permanent magnets 5*a*, 5*b* and intermediate rings 4*a*, 4*b*, being enclosed by closed channel. Each of the permanent magnets 5*a*, 5*b*, pole pieces 3*a*, 3*b* and intermediate rings 4*a*, 4*b* has a circular shape when viewed in the axial direction of the cylindrical anode 2. The intermediate rings 4*a* and 4*b* are discs made of mild steel, and have outer diameters which are intermediate between the outer diameters of the permanent magnets 5*a* and 5*b* and the outer diameters of the pole pieces 3*a* and 3*b*, in order to concentrate the magnetic fluxes generated by the permanent magnets 5*a* and 5*b* on the pole pieces 3*a* and 3*b*, respectively, at a high efficiency.

A plurality of cooling fins 7 for cooling the magnetron are provided on the outer circumferential surface of the cylindrical anode 2. A filter 8 is provided at one end of the oscillating part, with the filter 8 including therein a choke coil and a feed-through capacitor to prevent the leakage of microwaves. End shields 11*a* and 11*b* are soldered to a filament 10 of the cathode 1, and cathode input lead wires 12*a* and 12*b* are electrically connected to the end shields 11*a* and 11*b* pass through-holes respectively provided in the pole piece 3*b*, intermediate ring 4*b*, permanent magnet 5*b* and yoke 6*b*, and are then led to input terminals 13 through the choke coil and the feed-through capacitor. An output terminal 14 is arranged at the other end of the oscillating part, with a part of an antenna 15 being into the terminal 14. The antenna 15 for guiding the microwaves, induced in the resonant cavities to the output terminal 14, is led from the anode vane 2*a* to the end terminal 14 through holes respectively provided in the pole piece 3*a*, intermediate ring 4*a*, permanent magnet 5*a*, and yoke 6*a*. Thus, a great part of microwaves induced in the resonant cavities reach the output terminal 14, and are then propagated through a waveguide (not shown) to, for example, a microwave oven.

In the magnetron of the above noted construction, that part of input power which is not converted into microwaves, is mainly converted at the anode 2 into heat, which is conducted to the permanent magnets 5*a* and 5*b* through the pole pieces 3*a* and 3*b* and intermediate rings 4*a* and 4*b*. Thus, the temperature of each of the permanent magnets is increased and, accordingly, the magnetomotive force of each permanent magnet is decreased, the operating voltage is lowered, and the microwave output is reduced. Although the ferrite magnet is less expensive than a metallic magnet made of, for example, alnico, the ferrite magnet is inferior in temperature characteristic to the metallic magnet. More particularly, the temperature coefficient of magnetic flux density is 0.02 and 0.2%/°C. in the alnico magnet and ferrite magnet, respectively. That is, the ferrite magnet is higher in temperature coefficient of magnetic flux density than the alnico magnet by one order of magnitude. Accordingly, the microwave output is remarkably decreased due to a temperature rise in the permanent magnet, when the ferrite magnet is employed.

In view of the above difficulties, a construction such as disclosed in a Japanese Patent Application Laid-open No. 108,960/74 has been employed in which, as shown in FIG. 1, each of the intermediate rings 4*a* and 4*b* is provided on the surface thereof with projections 41 for keeping the respective permanent magnets 5*a* and 5*b* in point contact with the intermediate rings 4*a* and 4*b*, in order to block the heat flow from the intermediate rings 4*a* and 4*b* to the permanent magnets 5*a* and 5*b*, thereby preventing the deterioration of the permanent magnets 5*a* and 5*b*. According to this structure, the temperature rise in each of the permanent magnets 5*a* and 5*b* can be remarkably reduced as compared with a structure such that each of the intermediate rings 4*a* and 4*b* has no projection.

In recent years, however, to make the cooling system for a magnetron inexpensive, a cooling fan provided in a microwave oven is generally small-sized so that the amount of cooling air is reduced, and further the number of cooling fins provided within the magnetron is reduced. Accordingly, the cylindrical anode 2 is heated to a higher temperature. Therefore, it is required to provide a structure which is more excellent in adiabatic effect. In the conventional structure shown in FIG. 1, since the intermediate rings 4*a* and 4*b* are kept in plane contact with the pole pieces 3*a* and 3*b*, respectively, the intermediate rings 4*a* and 4*b* are heated to substantially the same temperature as the anode 2. Therefore, even though the permanent magnets 5*a* and 5*b* are respectively in point contact with the intermediate rings 4*a* and 4*b* by the projections 41, the permanent magnets 5*a* and 5*b* are heated to a temperature corresponding to the temperature of the intermediate rings 4*a* and 4*b*. Accordingly, there is a limit in reducing the cost of the cooling system for the magnetron, resulting in no satisfactory in the cost reduction.

Further, when the oscillating part, intermediate rings 4*a* and 4*b* and permanent magnets 5*a* and 5*b* are sandwiched in a stacked relationship between and fixed by the yokes 6*a* and 6*b*, it is very important that the oscillating part the intermediate rings 4*a*, 4*b*, and permanent magnets 5*a* 5*b* are tightly bound to protect the cathode 1 which is relatively readily broken by a mechanical shock from the outside. Therefore, the oscillating part, intermediate rings 4*a* and 4*b*, permanent magnets 5*a* and 5*b* and yokes 6*a* and 6*b* are required to have a high dimensional accuracy, which makes high the manufacturing cost of magnetron. As shown in FIGS. 2, 3, 4 and 5, in accordance with the present invention, each of intermediate rings 9*a* and 9*b* includes a disc portion and projections 91 and 92 respectively provided on both surfaces thereof so that the intermediate ring 9*a* is kept in point contact with both of the pole piece 3*a* and permanent magnet 5*a* by the projections 91 and 92, and the intermediate ring 9*b* is kept in point contact with both of the pole piece 3*b* and permanent magnet 5*b* by its projections 91 and 92. Thus, the temperature rise in each of the intermediate rings 9*a* and 9*b* is suppressed, and a higher adiabatic effect can be attained to the permanent magnets 5*a* and 5*b*.

Figure 3:
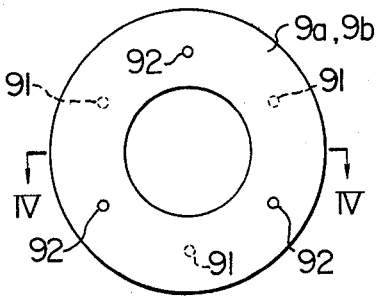
FIG. 3 is a plan view showing an intermediate ring used in the embodiment shown in FIG. 2.
Figure 4:
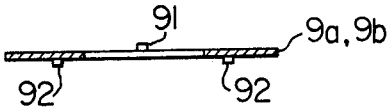
FIG. 4 is a cross-sectional view of the intermediate ring shown in FIG. 3, taken along the line IV—IV.
Figure 2:
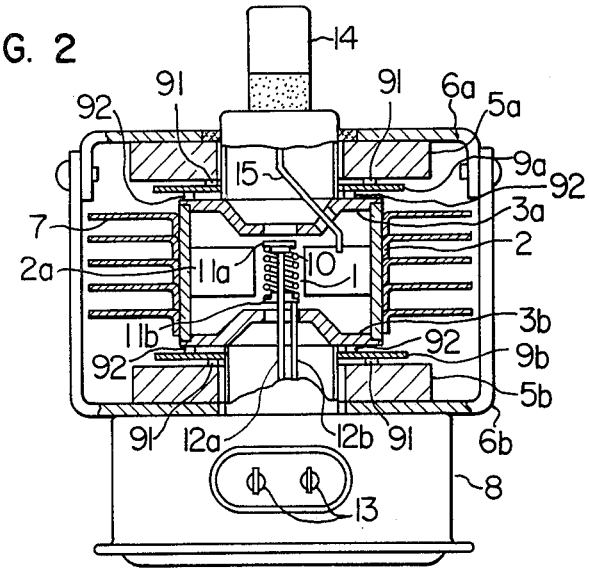
FIG. 2 is an elevational view partially in cross-section showing an embodiment of a magnetron according to the present invention.

It was found by experiments that the adiabatic effect was affected by the number of projections 91, 92, and the highest adiabatic effect can be obtained when the irreducible minimum number of projections, i.e. two projections 91, 92 are provided on each surface of the intermediate ring 9*a*, 9*b*; however, an intermediate ring 9*a*, 9*b* with two projections 91, 92 on each surface will be inclined and difficult to handle for maintaining it in position for assembling the magnetron. For this reason, as shown in FIG. 3, three projections 91 are provided on one surface of each intermediate ring 9*a*, 9*b* in such a manner that these projections are disposed substantially equidistantly along the circumference and three projections 92 are provided on the other surface in a similar manner. Such an intermediate ring 9*a*, 9*b* is desirable from the practical point of view, since it is easy to construct the magnetron, and a satisfactory adiabatic effect can be obtained.

Figure 5:
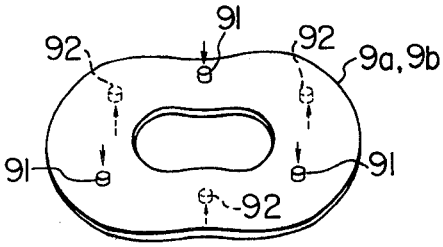
FIG. 5 is a perspective view for explaining a deformed state of the intermediate ring shown in FIGS. 3 and 4.

Further, in case where each of the projections 91 is arranged halfway between two of three projections 92, and where the total length of the oscillating part, intermediate rings 9*a* and 9*b*, and permanent magnets 5*a* and 5*b* in the axial direction of the anode 2 is slightly greater than the distance in the axial direction between the yokes 6*a* and 6*b* when assembled, each of the projections 91 and 92 is moved in the direction as indicated by an arrow as shown in FIG. 5, and therefore each of the intermediate rings 9*a* and 9*b* is deformed to have a wavy shape. Such deflection can absorb a dimensional error in each part and also absorb mechanical shocks applied to the magnetron from the outside. Although a gap between each intermediate ring and the neighboring permanent magnet which is formed by the projections 91, and a gap between each intermediate ring and the neighboring pole piece which is formed by the projections 92, increase the magnetic reluctance and therefore generate a loss, the above-mentioned deformation of each intermediate ring can reduce such a loss.

The intermediate rings 9*a* and 9*b* are made of mild steel, and the projections 91 and 92 have a height of about 0.4 mm. The outer diameters of the intermediate rings are larger than the outer diameters of the pole pieces 3*a* and 3*b*, and are smaller than the outer diameters of the permanent magnets 5*a* and 5*b*. For example, the outer diameters of the pole pieces 3*a*, 3*b*, the permanent magnets 5*a*, 5*b*, and the intermediate rings 9*a*, 9*b* are about 45 mm, about 65 mm, and about 55 to 60 mm, respectively. Such intermediate rings 9*a* and 9*b* can be readily prepared through press working.

I claim:

1. A magnetron including a cylindrical anode, a cathode disposed on an axis of said cylindrical anode, a pair of pole pieces respectively arranged at both ends of said cylindrical anode, a pair of permanent magnets each arranged on an outside of the corresponding one of said pole pieces in an axial direction of said cylindrical anode, and a pair of intermediate rings each arranged between one of said pole pieces and the corresponding one of said permanent magnets, and having a circular plane shape, wherein each of said intermediate rings comprising: a disc portion; a plurality of first projections formed on one of the surfaces of said disc portion and abutting on the corresponding pole piece; and a plurality of second projections formed on the other surface of said disc portion and abutting on the corresponding permanent magnet.

2. A magnetron according to claim 1, wherein each of said intermediate rings is provided with three of said first projections arranged substantially equidistantly along a circumference and with three of said second projections arranged substantially equidistantly along the circumference and each disposed halfway between two of the first projections.

3. A magnetron according to claim 1, wherein a total axial length of the anode, pole pieces, permanent magnets, intermediate rings, and projections are greater than an axial length of supporting yoke means of the magnetron such that the intermediate rings are deformed during an assembly of the magnetron.

* * * * *